US012090387B1

(12) United States Patent
Ballam

(10) Patent No.: US 12,090,387 B1
(45) Date of Patent: Sep. 17, 2024

(54) PRIVACY ENHANCING CARD HOLDER FOR BOARD GAMES AND CARD GAMES

(71) Applicant: Mohammad F. N. N. Ballam, Rumaithiya (KW)

(72) Inventor: Mohammad F. N. N. Ballam, Rumaithiya (KW)

( * ) Notice: Subject to any disclaimer, the term of this patent is extended or adjusted under 35 U.S.C. 154(b) by 0 days.

(21) Appl. No.: 18/583,550

(22) Filed: Feb. 21, 2024

(51) Int. Cl.
*A63F 1/10* (2006.01)

(52) U.S. Cl.
CPC ..... *A63F 1/10* (2013.01); *A63F 2250/58* (2013.01)

(58) Field of Classification Search
CPC ..... A63F 1/10; A63F 2250/58
See application file for complete search history.

(56) References Cited

U.S. PATENT DOCUMENTS

| | | | | |
|---|---|---|---|---|
| 1,105,835 | A * | 8/1914 | Radley | A47F 3/001 40/120 |
| 2,634,132 | A | 4/1953 | Freedman | |
| 2,717,156 | A | 9/1955 | Nelson | |
| 4,468,032 | A | 8/1984 | Stewart | |
| 4,798,284 | A * | 1/1989 | Wakelin | B42F 17/08 220/558 |
| 5,094,455 | A | 3/1992 | Persuy | |
| D338,922 | S | 8/1993 | Schreib | |
| 5,590,880 | A | 1/1997 | Flam | |
| 6,073,794 | A * | 6/2000 | Bidot | A47B 88/975 312/348.3 |
| D447,520 | S * | 9/2001 | Rodriguez | D21/392 |
| 7,568,698 | B2 | 8/2009 | Estes | |
| 9,001,502 | B1 * | 4/2015 | Cowan | B44C 1/105 361/679.01 |
| 9,085,119 | B2 | 7/2015 | Haddock | |
| 2003/0052448 | A1 * | 3/2003 | Bertrand | A63F 1/10 273/148 R |
| 2015/0174472 | A1 * | 6/2015 | Keeling | A63F 1/062 273/148 A |

FOREIGN PATENT DOCUMENTS

AU 712576 B3 11/1999

OTHER PUBLICATIONS

Exqualine Wooden Playing Card Holder Tray Rack, retrieved Jun. 29, 2023, Amazon.com.

* cited by examiner

*Primary Examiner* — Michael D Dennis
(74) *Attorney, Agent, or Firm* — Nath, Goldberg & Meyer; Joshua B. Goldberg

(57) ABSTRACT

A card holder for board games that provides enhanced privacy and prevents unauthorized viewing of card information. The card holder incorporates angled card slots which tilt the cards towards the player, making it difficult for other players to see the card information without intentional effort. Additionally, the card holder includes privacy shields positioned to the side of each slot, further obstructing the view of cards from adjacent players.

16 Claims, 8 Drawing Sheets

PRIVACY ENHANCING CARD HOLDER FOR BOARD GAMES AND CARD GAMES

BACKGROUND

1. Field

The present disclosure relates to games, in particular, to an apparatus to aid a game player in keeping information from opposing players.

2. Description of the Related Art

Privacy and unauthorized viewing of card information in board games and card games pose significant challenges to maintain fairness and gameplaying integrity. In multiplayer games, players often need to hold and display their cards while keeping the pertinent card information (i.e., value and/or suit) concealed from opponents. However, existing card holders have limitations in effectively addressing this issue.

The importance of privacy in gameplay cannot be understated. It ensures that players make decisions based on only their own knowledge and strategies, rather than taking advantage of glimpses into opponents' cards. Unauthorized viewing compromises the integrity of the game, and can lead to unfair advantages, disrupting the overall gaming experience.

Existing card holders used in board games and card games can vary in design and functionality. Some common types of card holders include individual player screens, card trays, and card holders with compartments. While these alternatives provide basic organizational options for manipulating a plethora of cards, they often fall short in maintaining privacy and preventing unauthorized viewing.

These card holders have limitations in their ability to shield cards effectively due to inadequate coverage or transparency of materials which can unintentionally expose card information to other players. Moreover, some card holders do not accommodate cards having varying dimensions, or quantities, limiting their versatility.

Accordingly, there is a need for an improved card holder which provides a solution that not only securely holds the cards but also ensures maximum privacy, preventing unauthorized viewing and maintain fairness during gameplay. By addressing the limitations of the prior art card holders, the proposed card holder will enhance the gaming experience by promoting and ensuring a level playing field for all players.

SUMMARY

The present subject matter is directed towards a method and device for holding a plurality of playing cards in place while providing visual access to the cards to the respective player and restricting or eliminating visual access to the plurality of playing cards to other respective players.

The privacy enhancing card holder for board games and card games is designed to address the challenges of maintaining privacy, preventing unauthorized viewing, and enhancing the game playing experience. The proposed card holder incorporates key features such as angled card slots and privacy shields thus providing significant advantages over existing solutions.

The angled card slots are a fundament component of the design as they tilt the card towards the player. This strategic positioning obstructs the view from other players and makes it difficult for them to see the card information without intentional effort. By angling the cards in this manner, the privacy card holder ensures a higher level of player privacy, allowing the players to make informed decisions solely based on their own knowledge and strategy.

Additionally, the privacy shields positioned to the side of each card slot further enhance the privacy features of the card holder. These shields act as physical barriers effectively blocking the view of the cards from adjacent players. With the combination of the angled card slots and privacy shields, the proposed card holder offers comprehensive protection against unauthorized viewing, fostering a fair and level playing field for all gaming participants.

The present subject matter significantly improves the overall gameplaying experience. It promotes fairness by minimizing the potential for accidental or intentional information leakage, eliminating the risk of cheating. Players can fully engage in the game relying solely on their abilities and tactics, without concerns about others gaining glimpses into their own cards.

Furthermore, the privacy enhancing card holder is designed to be versatile and adaptable to different configurations to accommodate different card sizes and quantities. Its design allows for an easy insertion and retrieval of individual cards, ensuring convenience during gameplay.

In summary, the disclosed privacy enhancing card holder for board games and card games greatly improves the way the cards are held, providing a heightened level of privacy for the individual player by preventing unauthorized viewing by the other players. By incorporating angled card slots and privacy shields, the disclosed invention creates a fair and immersive gameplay environment where players can allocate their complete focus on decision making and strategy without worry.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF EMBODIMENTS

The following detailed description is merely exemplary in nature and is not intended to limit the described embodiments or the application and uses of the described embodiments. Any implementation described herein with the words "exemplary" or "illustrative" is not necessarily construed as preferred or advantageous over other implementations. All of the implementations described below are exemplary implementations provided to enable persons skilled in the art to make or use the embodiments of the disclosure and are not intended to limit the scope of the disclosure, which is defined by the claims. For the purposes of the description herein, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed therein are not to be considered as limiting, unless the claims expressly state otherwise.

Figure 1A:
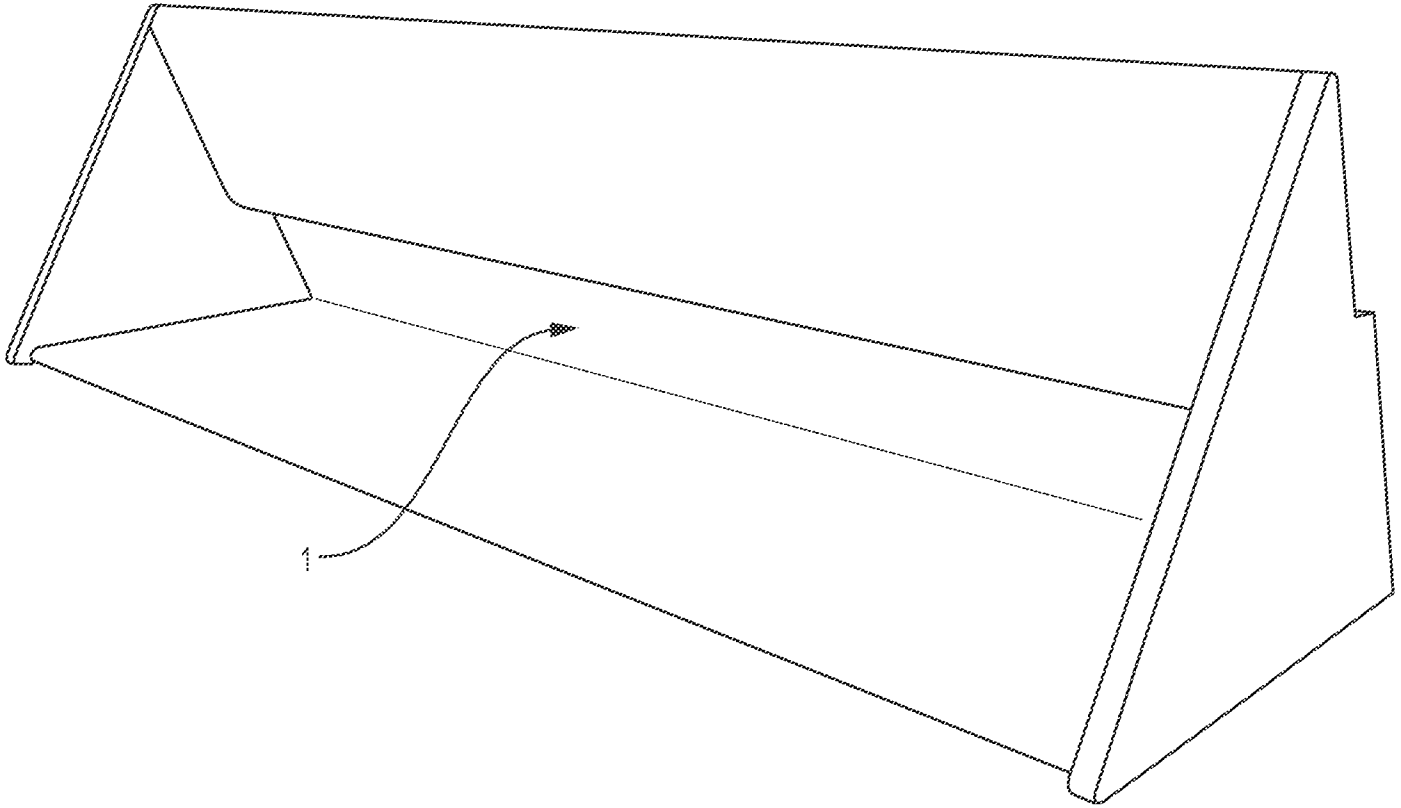
FIG. 1A is a diagram of an angled perspective view of the front side of the privacy card holder without cards.
Figure 1B:
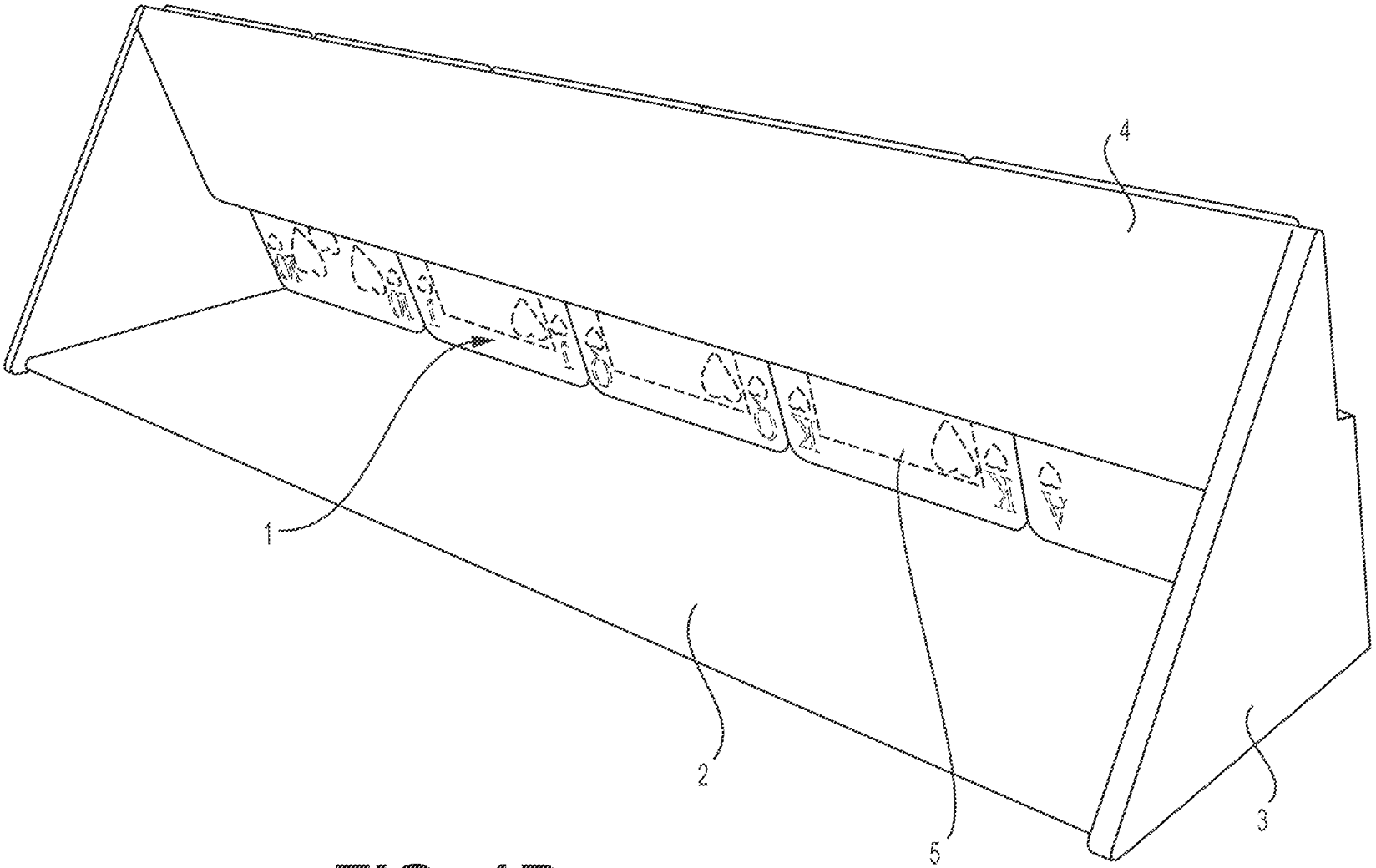
FIG. 1B is a diagram of an angled perspective view of the front side of the privacy card holder with cards.
Figure 2:
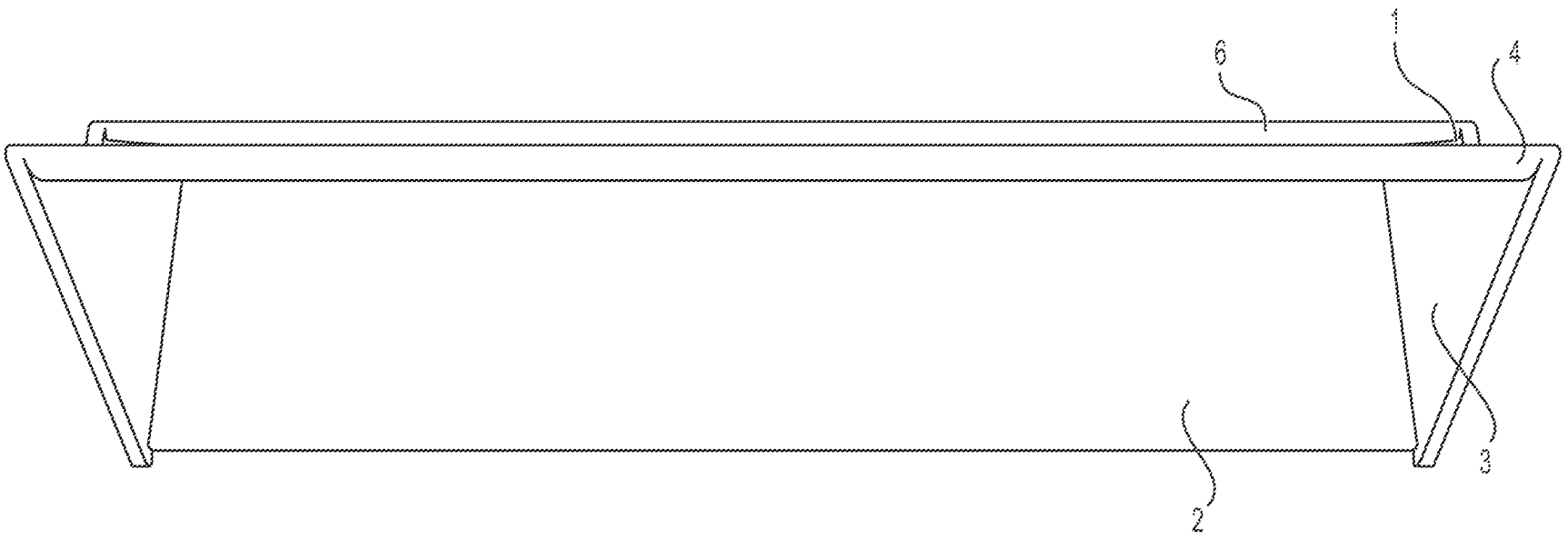
FIG. 2 is a top down view of the privacy card holder without cards.

As shown in FIGS. 1A-2, the card holder features a robust base 2 and card slots 4, 6 designed to securely hold the cards 5 in place during gameplay. The card holder is constructed using durable and lightweight materials, such as high-quality plastic, epoxy, wood, or acrylic materials, ensuring stability and ease of use. The dimensions of the privacy card holder are optimized to accommodate standard playing cards sizes commonly used in board games and card games.

In FIGS. 1A-2, the privacy enhancing card holder for board games and card games has a design that offers various options for the angled card slots providing flexibility and customization based upon the player's preferences. In FIGS. 1A and 1B, the privacy enhancing card holder is shown both without cards (FIG. 1A) and with cards (FIG. 1B) as a stand with two generally triangular end pieces that are the privacy shields 3, a rectangular base 2 between the two privacy shields, the upper back angled card slot 4 that is also between the two privacy shields 3 such that the cards bottom portion of the cards are visually accessible to the player. FIG. 2 is a top down view of the privacy card holder which shows both the upper back angled card slot 4 and the lower front angled card slot 6 and the small aperture or open space 1 where the cards are inserted into when the privacy enhancing card holder is use. During gameplay, a plurality of cards 5 would be inserted between the gap 1 formed between the upper back angled card slot 4 and the lower front angled card slot 6. The orientation of the card when residing within the privacy enhancing card holder is such that the card face tilts slightly towards the individual player and away from the center of the game table or the other players.

Figure 3:
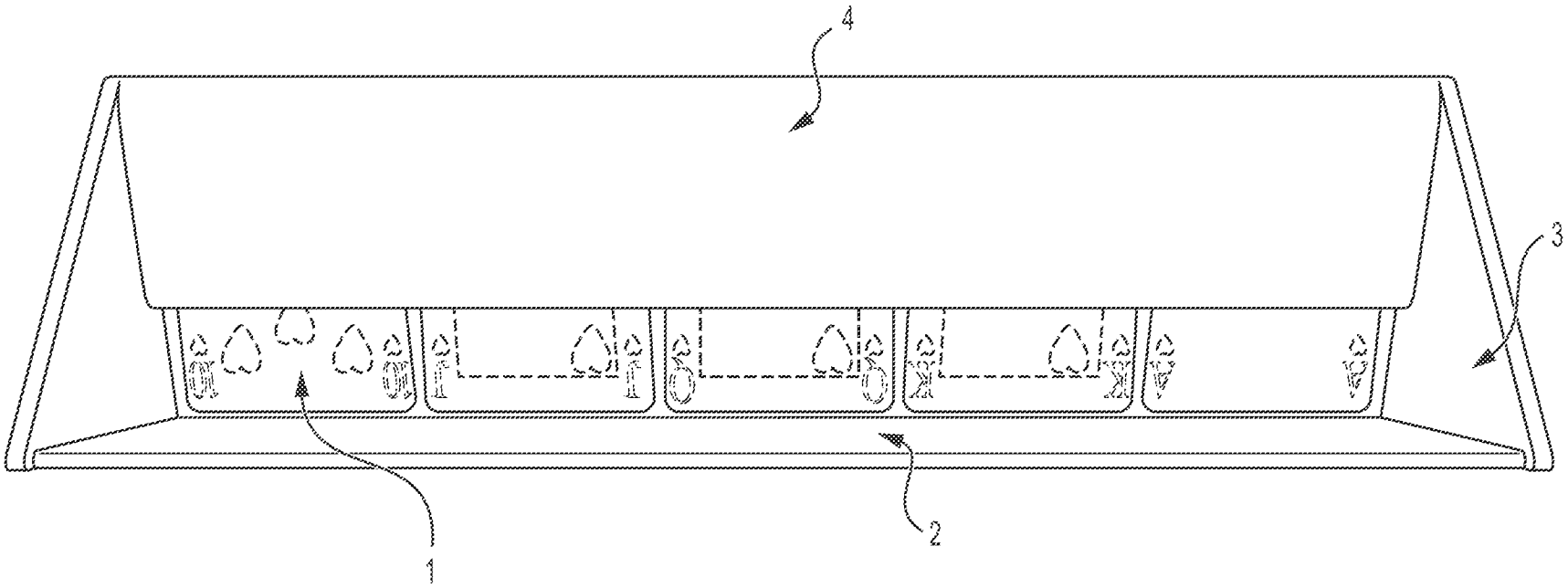
FIG. 3 is a diagram of a view of the front side of the privacy card holder with cards.

FIG. 3 is a front view of the privacy enhancing card holder showing five cards arranged from lowest value to highest value from left to right, respectively. Only a portion of the card face 5 is visible to the player as most of the card face 5 is obscured from the player by the upper back angled card slot 4. The upper back angled card slot 4 is rotatable such that it can be brought towards the player facing triangular edge of each privacy shield 3. This allows the card gap 1 to be widened between the lower front angled card slot 6 and the upper back angled card slot 4 such that thicker cards can be accommodated if needed. Also, a more severe tilt can be imparted to the plurality of cards 5 if desired by the particular player. Additionally, the upper back angled slot 4 can be made of a polarized filter transparent material 10 such that only the player directly in front of the privacy card holder is able to see the rest of the face of the cards 5. However, when viewed from the side, the material has a privacy feature that prevents the card from being visible to other players. It turns black, effectively blocking the side view of the cards and ensuring maximum privacy. This innovative feature offers an extra layer of privacy protection. Players can confidently place their cards 5 in the inner slots 1, knowing that their card information remains concealed from others, even from different angles. The combination of angled card slots and the filter transparent inner slot with the privacy option further enhances the privacy features of the card holder, promoting fairness and integrity during gameplay. Also, a mirror 2 can be placed on the upper surface of the base of the privacy enhancing card holder such that the card value and suit indicia can be flipped up visually for easier viewing by the player.

Figure 4:
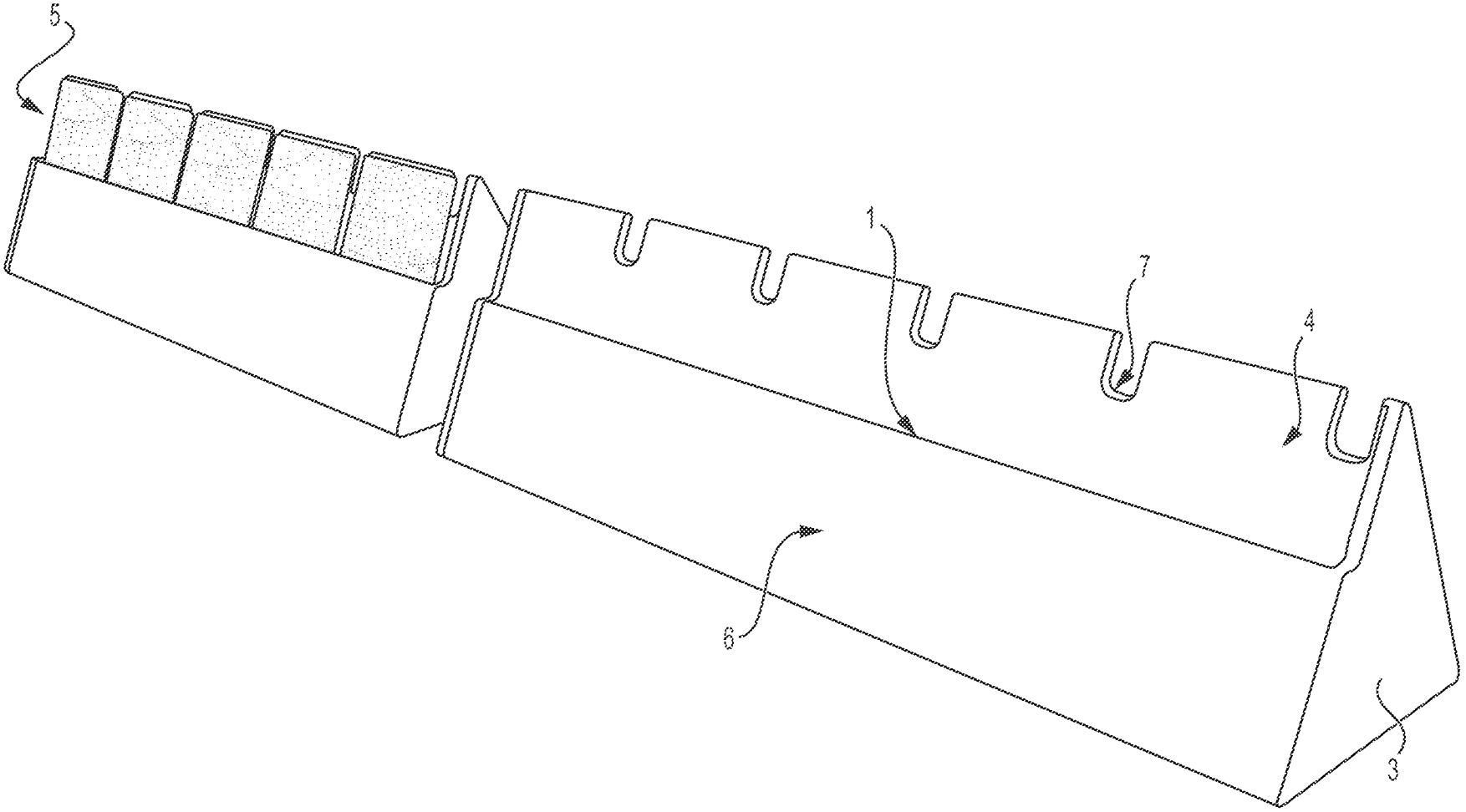
FIG. 4 is a diagram of an angled perspective view of the back side of the privacy card holder with hole options both without cards and with cards.
Figure 5:
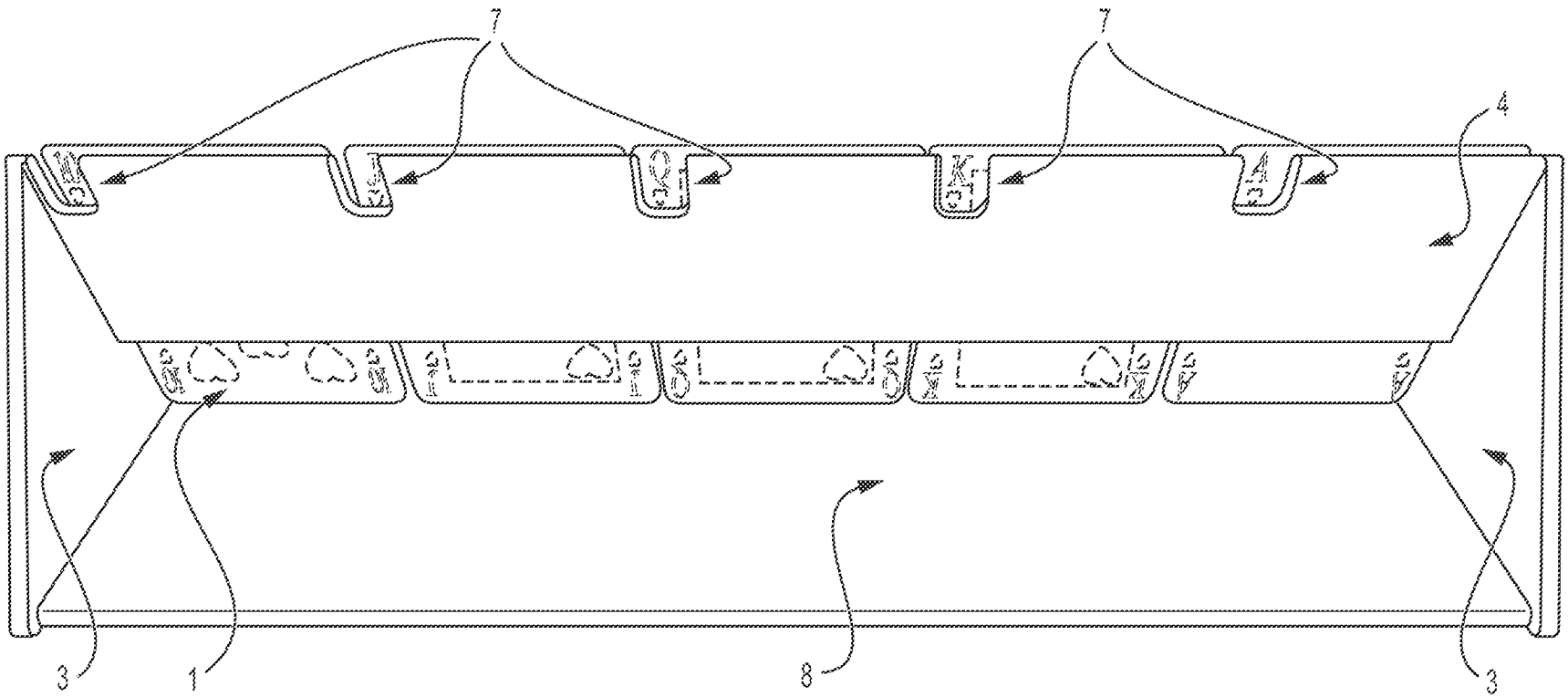
FIG. 5 is a diagram of a view of the front side of the privacy card holder with hole options with cards.

FIGS. 4 and 5 shows an additional embodiment where small holes 7 are placed at the top of upper back angled card slots 4. These holes serve the purpose of providing the player with a better view of the card information while still maintaining privacy. The holes are strategically positioned to align with the important details of the card 5 such as the numerical value and card suit information allowing the player to easily read the values or symbols without giving away the complete card image to the other players.

Continuing the exploration of different design options, the card holder can incorporate innovative variations of angled cards slots. These could include mechanisms such as rotating upper back angled panels 4 as discussed above and adjustable flaps. These features provide additional control over the level of visibility and privacy, allowing players to reveal or conceal specific portions of the card as desired during gameplay. These different design options for the angled card slots offer players the opportunity to customize their card playing experience based on their preferences and gameplay needs. Whether it's through holes on top for improved visibility, open bottoms for card type identification, or innovative mechanisms, the privacy enhancing card holder design ensures that players can make informed decisions while maintain privacy and thus ensuring fairness.

Figure 6:
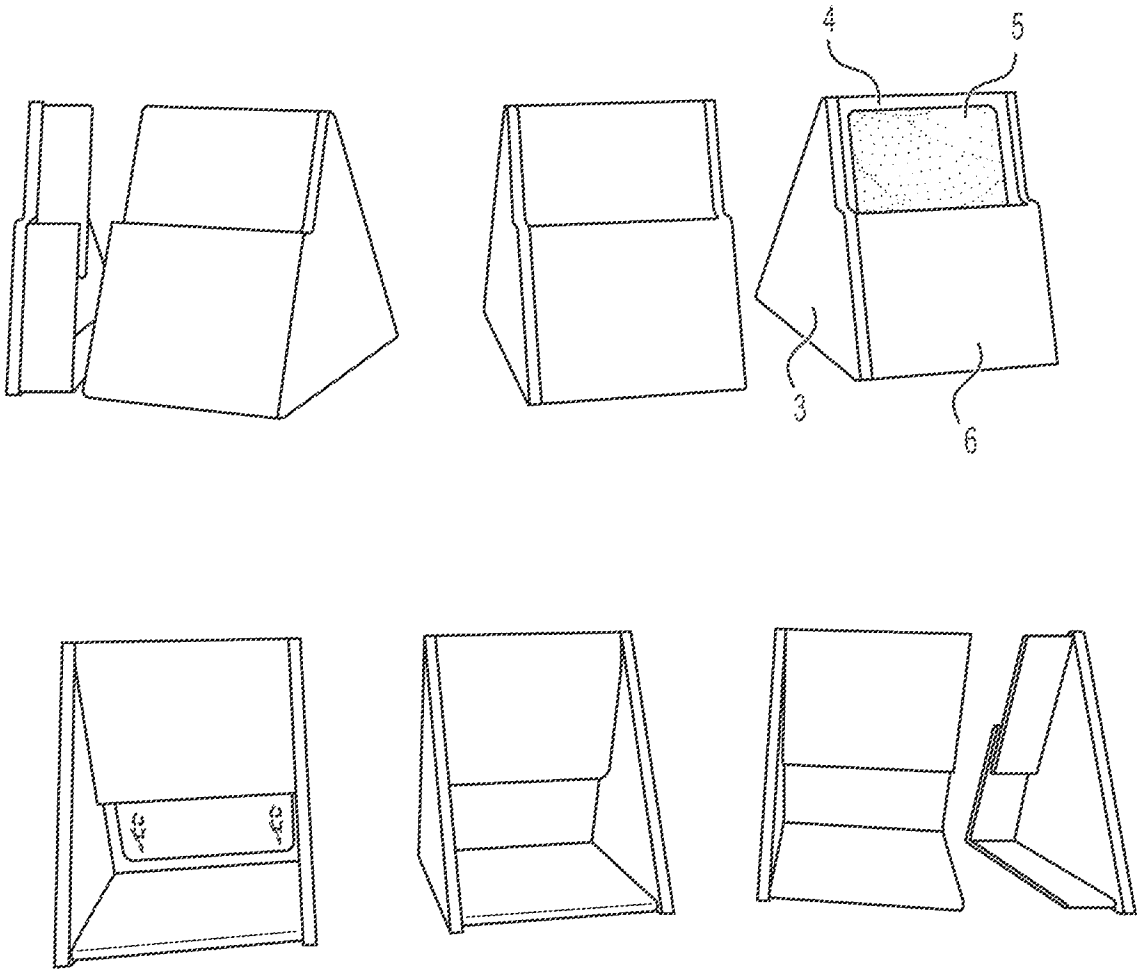
FIG. 6 is a diagram of back view and a front view of a single card privacy card holder with an extender.
Figure 7:
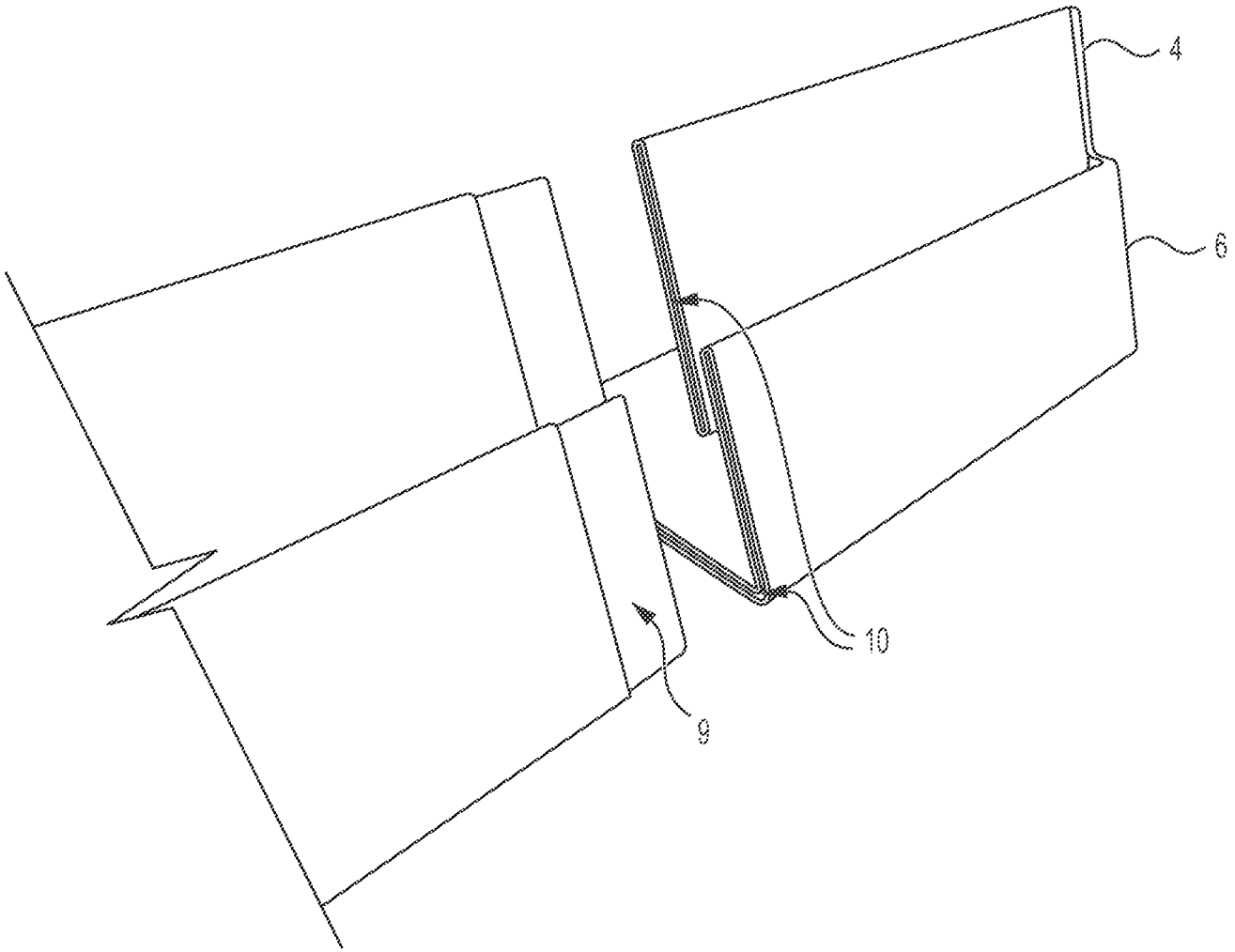
FIG. 7 is a diagram of an extender as a part of privacy card holder of FIG. 1.

FIGS. 6-7 show alternative embodiments of the card holder design adaptable to accommodate various card sizes and quantities. In FIG. 6, the privacy enhancing card holder can be sized to accommodate a single card, with slots that can be lengthened using extenders 9. In FIG. 7, a privacy enhancing card holder sized to hold a plurality of cards can also accommodate an extender 9. The extender can be pulled out from holes 10 in the upper angled back slot 4 and the lower front angled slot allowing players to widen or narrow them to fit different card dimensions. This flexibility ensures that the card holder can be utilized with a wide range of board games, card games, and role playing games, irrespective of the specific card sizes and quantities involved.

It is to be understood that the privacy enhancing card holder is not limited to the specific embodiments described above but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A privacy enhancing card holder for board games and card games, comprising:

a first angled card slot wall;

a second angled card slot wall;

a first privacy shield attached to a first end of the first angled card slot wall and a first end of the second angled card slot wall along a back edge of the first privacy shield;

a second privacy shield attached to a second end of the first angled card slot wall and a second end of the second angled card slot wall along a back edge of the second privacy shield; and a base member attached to a bottom edge of the first privacy shield and a bottom edge of the second privacy shield;

wherein the first angled card slot wall and the second angled card slot wall are parallel and attached to the back edges of the first and second privacy shields, the first angled card slot wall extending from an uppermost point of the back edges of the first and second privacy shields downward along part of a length of the back edges of the first and second privacy shields, and the second angled card slot wall extending from a lowermost point of the back edges of the first and second privacy shields upward along part of a length of the back edges of the first and second privacy shields, the second angled card slot wall spaced laterally outward with respect to the first angled card slot wall such that an opening is formed between the first angled card slot wall and the second angled card slot wall for holding one or more playing cards.

2. The privacy enhancing card holder for board games and card games as recited in claim 1, wherein said base member has a mirror affixed to a top surface of said base member where said mirror reflects the card information of the plurality of cards to the player.

3. The privacy enhancing card holder for board games and card games as recited in claim 1, wherein the first angled card slot wall is constructed from a polarized filter material that allows only the player directly in front of the privacy enhancing card holder to view the card information of the plurality of cards while obscuring the card information at other viewing angles.

4. The privacy enhancing card holder for board games and card games as recited in claim 1, wherein the first angled card slot wall has one or more holes for viewing card information.

5. The privacy enhancing card holder for board games and card games as recited in claim 1, further comprising:

the first angled card slot wall having a hole therein where the hole contains a first extender designed to extend from the first angled card slot wall increasing a length of the first angled card slot wall to accommodate a second plurality of cards tilting towards a player where the second plurality of cards is greater than the first plurality of cards; and the second angled card slot wall having a hole therein where the hole contains a second extender designed to extend from the second angled card slot wall increasing a length of the second angled card slot wall to accommodate a second plurality of cards tilting towards a player where the second plurality of cards is greater than the first plurality of cards.

6. The privacy enhancing card holder for board games and card games as recited in claim 1, wherein the plurality of cards, the back edges of the first and second privacy shields, and the first and second angled card slot walls tilt toward a player viewing the plurality of cards.

7. The privacy enhancing card holder for board games and card games as recited in claim 1, wherein the first privacy shield and second privacy shield are triangular.

8. The privacy enhancing card holder for board games and card games as recited in claim 1, wherein the first angled card slot wall and second angled card slot wall partially overlap each other near a midpoint of the back edges of the first and second privacy shields.

9. The privacy enhancing card holder for board games and card games as recited in claim 1, wherein the first privacy shield and second privacy shield include a respective upper back edge portion and lower back edge portion, wherein the lower back edge portion is spaced laterally outward from the upper back edge portion.

10. A privacy enhancing card holder for board games and card games, comprising:

a first angled card slot wall, wherein the first angled card slot wall is constructed from a polarized filter material;

a second angled card slot wall;

a first privacy shield attached to a first end of the first angled card slot wall and a first end of the second angled card slot wall along a back edge of the first privacy shield;

a second privacy shield attached to a second end of the first angled card slot wall and a second end of the second angled card slot wall along a back edge of the second privacy shield;

a base member attached to a bottom edge of the first privacy shield and a bottom edge of the second privacy shield; and wherein the first angled card slot wall and second angled card slot wall are parallel and attached to the back edges of the first and second privacy shields, the first angled card slot wall extending from an uppermost point of the back edges of the first and second privacy shields downward along part of a length of the back edges of the first and second privacy shields, and the second angled card slot wall extending from a lowermost point of the back edges of the first and second privacy shields upward along part of a length of the back edges of the first and second privacy shields, the second angled card slot wall spaced laterally outward with respect to the first angled card slot wall such that an opening is formed between the first angled card slot wall and the second angled card slot wall for holding one or more playing cards.

11. The privacy enhancing card holder for board games and card games as recited in claim 10, wherein said base member has a mirror affixed to a top surface of said base member where said mirror reflects the card information of the plurality of cards to the player.

12. The privacy enhancing card holder for board games and card games as recited in claim 10, wherein the polarized filter material allows only a player directly in front of the privacy enhancing card holder to view the card information of the plurality of cards while obscuring the card information at other viewing angles.

13. The privacy enhancing card holder for board games and card games as recited in claim 10, wherein the first angled card slot wall has one or more holes for viewing card information.

14. The privacy enhancing card holder for board games and card games as recited in claim 10, further comprising:

the first angled card slot wall having a hole therein where the hole contains a first extender designed to extend from the first angled card slot wall increasing a length of the first angled card slot wall to accommodate a second plurality of cards tilting towards a player where the second plurality of cards is greater than the first plurality of cards; and the second angled card slot wall having a hole therein where the hole contains a second extender designed to extend from the second angled card slot wall increasing a length of the second angled card slot wall to accommodate a second plurality of cards tilting towards a player where the second plurality of cards is greater than the first plurality of cards.

15. The privacy enhancing card holder for board games and card games as recited in claim 10, wherein the first angled card slot wall and second angled card slot wall partially overlap each other near a midpoint of the back edges of the first and second privacy shields.

16. The privacy enhancing card holder for board games and card games as recited in claim 10, wherein the first privacy shield and second privacy shield include a respective upper back edge portion and lower back edge portion, wherein the lower back edge portion is spaced laterally outward from the upper back edge portion.

* * * * *